US006509874B1

(12) United States Patent
Kolak et al.

(10) Patent No.: US 6,509,874 B1
(45) Date of Patent: Jan. 21, 2003

(54) REACTIVE MATCHING FOR WAVEGUIDE-SLOT-MICROSTRIP TRANSITIONS

(75) Inventors: Frank Kolak, Billerica, MA (US); Eswarappa Channabasappa, Nashua, NH (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/905,245

(22) Filed: Jul. 13, 2001

(51) Int. Cl.[7] ..... H01Q 1/38
(52) U.S. Cl. ..... 343/700 MS; 343/771
(58) Field of Search ..... 343/700 MS, 745, 343/749, 767, 770, 771, 846, 848; 333/26, 33

(56) References Cited

U.S. PATENT DOCUMENTS 5,010,351 A 4/1991 Kelly ..... 343/771
5,990,844 A * 11/1999 Dumont et al. ..... 29/600
6,127,901 A 10/2000 Lynch ..... 333/26
6,133,877 A * 10/2000 Sandstedt et al. ..... 333/24 C
6,144,344 A * 11/2000 Kim et al. ..... 343/700 MS
6,188,361 B1 * 2/2001 George et al. ..... 343/700 MS
6,313,807 B1 * 11/2001 Kolak ..... 343/700 MS
6,377,217 B1 * 4/2002 Zhu et al. ..... 343/700 MS
6,396,440 B1 * 5/2002 Chen ..... 343/700 MS

* cited by examiner

*Primary Examiner*—Tan Ho

(57) ABSTRACT

A millimeter wave radar system including a microstrip antenna array that provides reduced return loss at microstrip antenna ports. The millimeter wave radar system includes at least one channel formed in a surface of a metal backing plate and a microstrip antenna array assembly. The assembly includes a plurality of conductive microstrips, a ground plane, and a dielectric substrate disposed between the conductive microstrips and the ground plane to form a plurality of microstrip transmission lines. The metal plate surface is mounted to the ground plate to form at least one waveguide. The ground plane has a plurality of slots formed therethrough to form a plurality of waveguide-to-microstrip transmission line transitions. The conductive microstrips have a plurality of tuning stubs coupled thereto and configured to provide reactive matching for the plurality of waveguide-to-microstrip transmission line transitions.

16 Claims, 3 Drawing Sheets

REACTIVE MATCHING FOR WAVEGUIDE-SLOT-MICROSTRIP TRANSITIONS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention relates generally to millimeter wave radar, and more specifically to a millimeter wave radar system including a microstrip antenna array that provides reduced return loss at microstrip antenna ports.

In recent years, millimeter wave radar has been increasingly employed in automotive vehicles as part of Adaptive Cruise Control (ACC) systems. A conventional millimeter wave radar system adapted for ACC applications includes an antenna assembly such as a microstrip antenna array assembly that can be mounted on an automotive vehicle. The microstrip antenna array assembly is configured to transmit one or more directional beams to scan a field of view ahead of the vehicle, and receive one or more electromagnetic waves reflected from objects within the field of view to collect certain information about the objects. For example, the collected information may include data on the relative speed, direction, and/or distance of the objects in a roadway ahead of the vehicle. Further, the ACC system may use that information to decide whether to alert a driver of the vehicle to a particular obstacle in the roadway and/or automatically change the speed of the vehicle to prevent a collision with the obstacle.

The microstrip antenna array assembly included in the conventional millimeter wave radar system comprises a waveguide disposed on a surface of a backing plate, and a microstrip antenna array assembly operatively disposed on a surface of the waveguide. The waveguide includes a plurality of sections having slots formed therethrough such that junctions of the waveguide, the slots, and the microstrip antenna array define a plurality of respective waveguide-slot-microstrip transitions. The conventional millimeter wave radar system further includes a transmitter/receiver unit configured to transmit electromagnetic wave energy to the waveguide for subsequent transfer to the microstrip antenna array via the waveguide-slot-microstrip transitions, and receive electromagnetic wave energy from the waveguide via the microstrip antenna array and the waveguide-slot-microstrip transitions.

One drawback of the conventional millimeter wave radar system is that there is typically significant return loss at the respective waveguide-slot-microstrip transitions due primarily to impedance mismatches between the waveguide and the microstrip antenna array. Such losses can adversely affect the transmission of directional beams by making it harder to achieve full illumination of the microstrip antenna array. This is particularly problematic in ACC systems because it can compromise the validity of information collected on objects in a roadway ahead of a vehicle, and can lead to improper decision making regarding whether to alert a driver of the vehicle and/or automatically change the speed of the vehicle to prevent a collision with an obstacle in the roadway.

It would therefore be desirable to have a millimeter wave radar system that can be employed in automotive ACC applications. Such a millimeter wave radar system would include a microstrip antenna array assembly providing reduced return loss at waveguide-slot-microstrip transitions to enhance the performance of the overall system.

BRIEF SUMMARY OF THE INVENTION

In accordance with the present invention, a millimeter wave radar system is disclosed that includes a microstrip antenna array providing reduced return loss at microstrip antenna ports. Benefits of the presently disclosed system are achieved by configuring the microstrip antenna array so that respective waveguide-slot-microstrip transitions at the microstrip antenna ports can more efficiently transfer electromagnetic wave energy between the microstrip antenna array and at least one waveguide included in the system.

In one embodiment, the millimeter wave radar system includes at least one channel formed in a metal backing plate and an adjacent microstrip antenna array assembly. The microstrip antenna array assembly includes a substantially planar circuit board, a single microstrip antenna array disposed on a first surface of the circuit board, and a ground plane disposed along a second circuit board surface such that a dielectric substrate of the circuit board is between the microstrip antenna array and the ground plane. The combination of the microstrip antenna array, the dielectric substrate, and the ground plane forms a plurality of microstrip transmission lines. Further, the ground plane is mounted to the metal backing plate comprising the at least one channel to form at least one waveguide. The ground plane has a plurality of slots formed therethrough along at least one line. The plurality of slots is transversely located relative to the microstrip transmission lines and longitudinally located relative to the waveguide, thereby forming a corresponding plurality of waveguide-slot-microstrip transitions for transferring electromagnetic wave energy between the microstrip transmission lines and the waveguide.

At least one open circuit stub is placed on each microstrip transmission line to match the impedance of the respective microstrip transmission line and the waveguide. The open circuit stubs are configured to add capacitive reactance to the respective microstrip transmission lines to cancel out a net inductive reactance at the waveguide-slot-microstrip transitions. In a preferred embodiment, the open circuit stubs are rectangular stubs positioned on the respective microstrip transmission lines so that each stub is in registration with a respective slot in the ground plane.

By employing capacitive stub matching on the microstrip antenna array to cancel out the net inductive reactance at the waveguide-slot-microstrip transitions, return loss is reduced at the microstrip antenna ports of the millimeter wave radar system. As a result, full illumination of the microstrip antenna array can be achieved, thereby making it easier to transmit a plurality of directional beams using the single microstrip antenna array.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which.

DETAILED DESCRIPTION OF THE INVENTION

A millimeter wave radar system that can be employed in automotive Adaptive Cruise Control (ACC) applications is disclosed. The millimeter wave radar system includes a single microstrip antenna array that uses capacitive stub matching at waveguide-slot-microstrip transitions to cancel out a net inductive reactance at the transitions, thereby reducing return loss at microstrip antenna ports to enhance the performance of the overall system.

Figure 1:
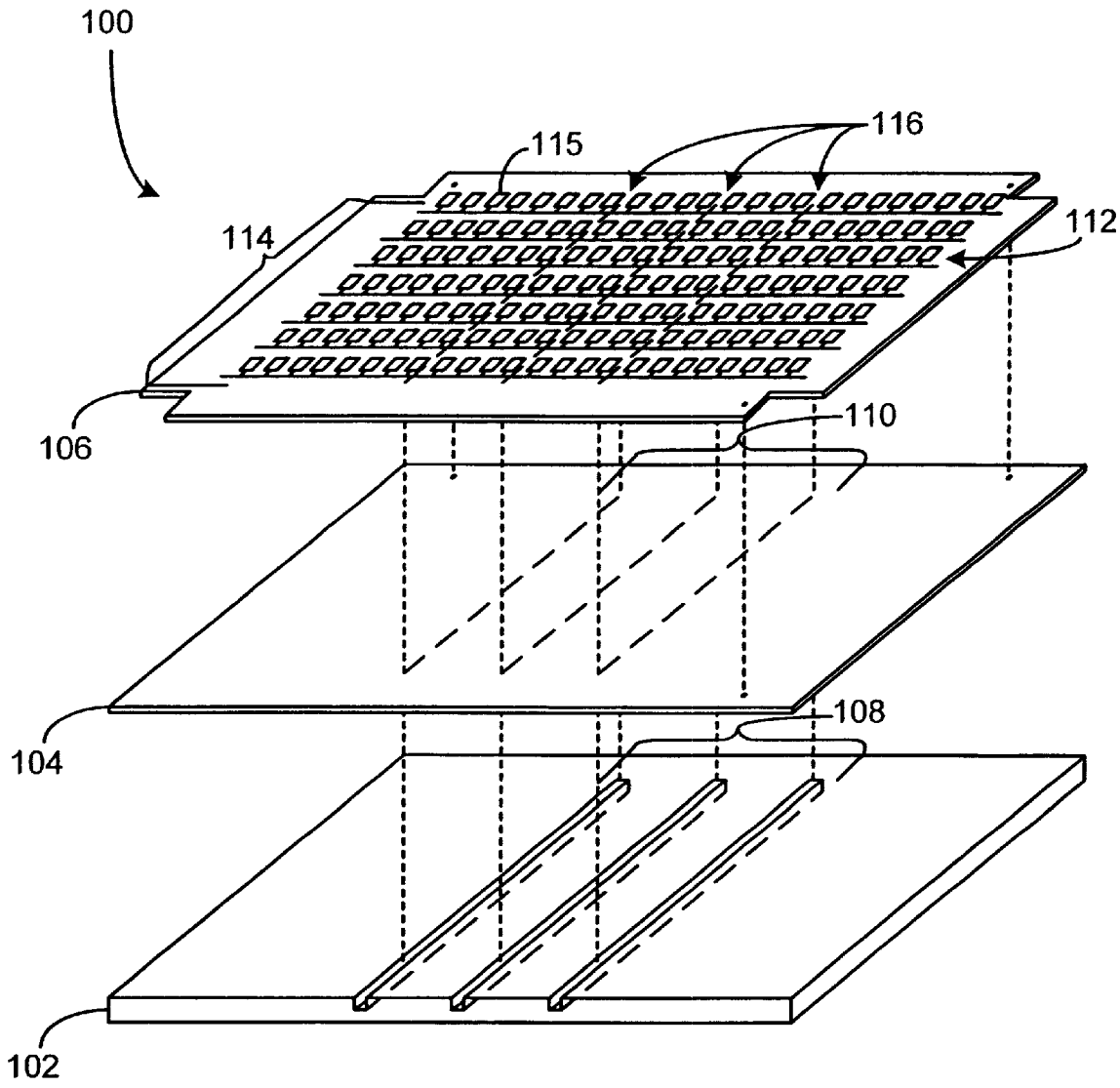
FIG. 1 is an exploded view of a millimeter wave radar system including a plurality of channels formed in a metal backing plate and an adjacent microstrip antenna array assembly according to the present invention.

FIG. 1 depicts an illustrative embodiment of a millimeter wave radar system 100 in accordance with the present invention. The millimeter wave radar system 100 includes a plurality of channels 108 formed in a metal backing plate 102; and, a microstrip antenna array assembly comprising a single microstrip antenna array 112 (also known as a patch antenna array) disposed on a surface of a substantially planar circuit board 106, and an adjacent ground plane 104.

The microstrip antenna array 112 includes a plurality of conductive microstrips shown generally at reference numeral 114, pluralities of rectangular open circuit tuning stubs shown generally at reference numeral 116 and positioned at regular intervals on the respective conductive microstrips 114, and pluralities of radiating antenna elements such as square antenna element 115 coupled to the respective conductive microstrips 114. Each radiating antenna element 115 is coupled to one of the conductive microstrips 114 by a microstrip feed line (not numbered). For example, the microstrip antenna array 112 comprising the conductive microstrips 114, the open circuit tuning stubs 116, and the square antenna elements 115 may be fabricated on the surface of the circuit board 106 by a conventional photo etching process or any other suitable process.

A dielectric substrate (not numbered) of the circuit board 106 separates the plurality of conductive microstrips 114 from the adjacent ground plane 104 to form a corresponding plurality of microstrip transmission lines. Further, the ground plane 104 is mounted to the metal backing plate 102 comprising the plurality of channels 108 to form a corresponding plurality of waveguides having generally rectangular cross-section. For example, respective opposing surfaces of the ground plane 104 may be bonded to the dielectric substrate of the circuit board 106 and the metal backing plate 102 using an epoxy resin or any other suitable adhesive.

In the illustrated embodiment, the ground plane 104 has a plurality of slots 110 formed therethrough and arranged in three (3) columns, in which each column includes the same number of collinear slots. Further, each conductive microstrip 114 has three (3) open circuit tuning stubs 116 positioned thereon such that each rectangular stub 116 is in registration with a respective slot 110. For example, the plurality of slots 110 may be formed through the ground plane 104 by etching or any other suitable technique.

Accordingly, when the ground plane 104 of the microstrip antenna array assembly is bonded to the metal backing plate 102, the plurality of slots 110 is transversely located relative to the respective conductive microstrips 114 and longitudinally located relative to the respective channels 108, thereby forming a corresponding plurality of waveguide-slot-microstrip transitions. Further, each one of the waveguide-slot-microstrip transitions is configured to transfer electromagnetic wave energy between a respective microstrip transmission line and a respective waveguide.

An exemplary embodiment of a slot-coupled patch antenna array is described in co-pending U.S. patent application Ser. No. 09/691,815 filed Oct. 19, 2000 entitled SLOT FED SWITCH BEAM PATCH ANTENNA now U.S. Pat. No. 6,313,807, which is incorporated herein by reference. That application describes a waveguide configured to receive respective electromagnetic waves; a plurality of slots in the waveguide through which the respective waves are fed; and, a patch antenna array comprising a plurality of microstrip transmission lines configured to receive the waves, produce phase differences in the waves, and transmit corresponding directional beams at predetermined angles via radiating antenna elements. In a similar manner, the three (3) waveguides of the millimeter wave radar system 100 (see FIG. 1) are configured to receive respective electromagnetic waves, and the plurality of waveguide-slot-microstrip transitions comprising the slots 110 is configured to transfer the respective waves to the single microstrip antenna array 112 to produce phase differences in the waves, thereby causing the transmission of three (3) directional beams by the radiating antenna elements 115.

Figure 2A:
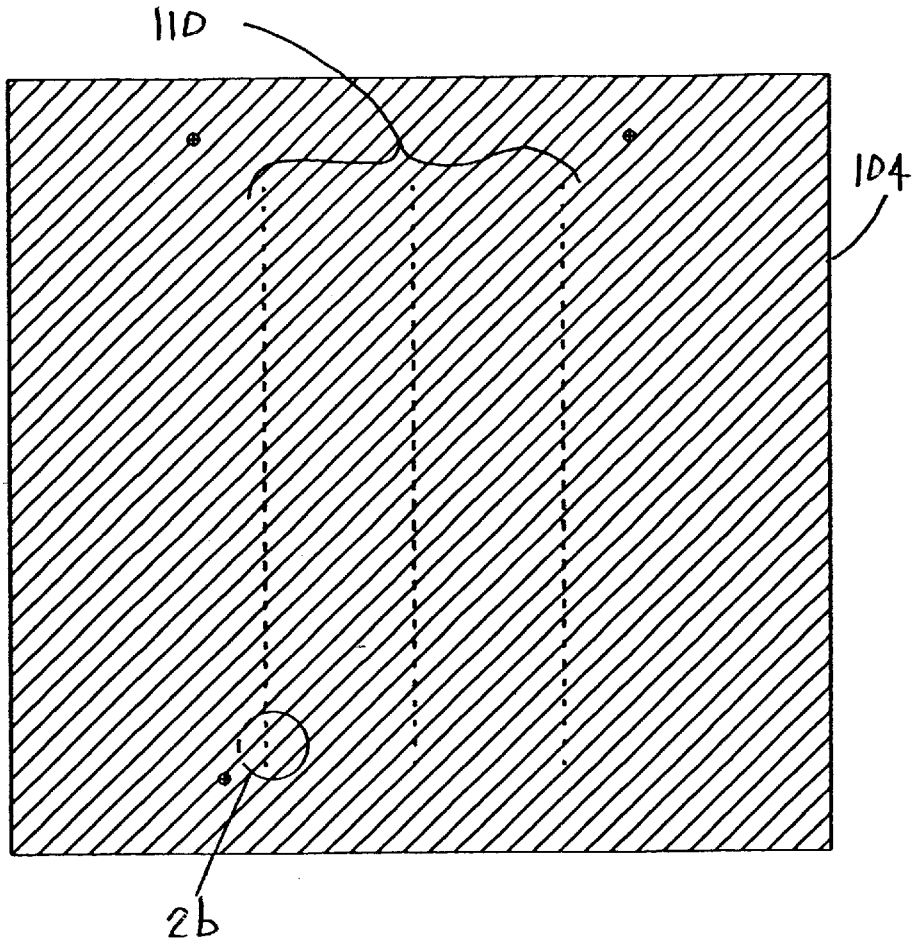
FIG. 2*a* is a bottom plan view of a ground plane included in the microstrip antenna array assembly illustrated in FIG. 1.
Figure 2B:
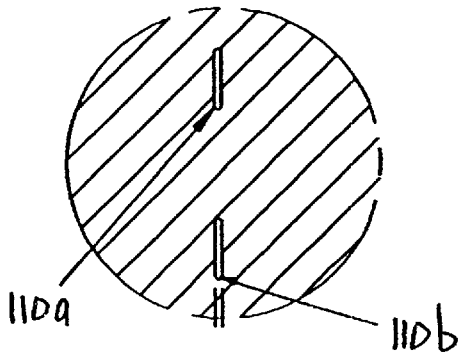
FIG. 2*b* is a detailed view of the ground plane illustrated in FIG. 2*a;*

FIG. 2*a* depicts a bottom plan view of the ground plane 104 included in the millimeter wave radar system 100 (see FIG. 1). In the illustrated embodiment, the plurality of slots 110 are formed through the ground plane 104 in three (3) columns, in which each column comprises thirty (30) collinear slots 110. It is noted that the ground plane 104 and the microstrip antenna array 112 (see FIG. 1) are arranged in the microstrip antenna array assembly so that one (1) slot 110 from each column feeds an electromagnetic wave to a respective microstrip transmission line. FIG. 2*b* depicts a detailed view of the ground plane 104 including illustrative embodiments of slots 110*a* and 110*b*.

Figure 3A:
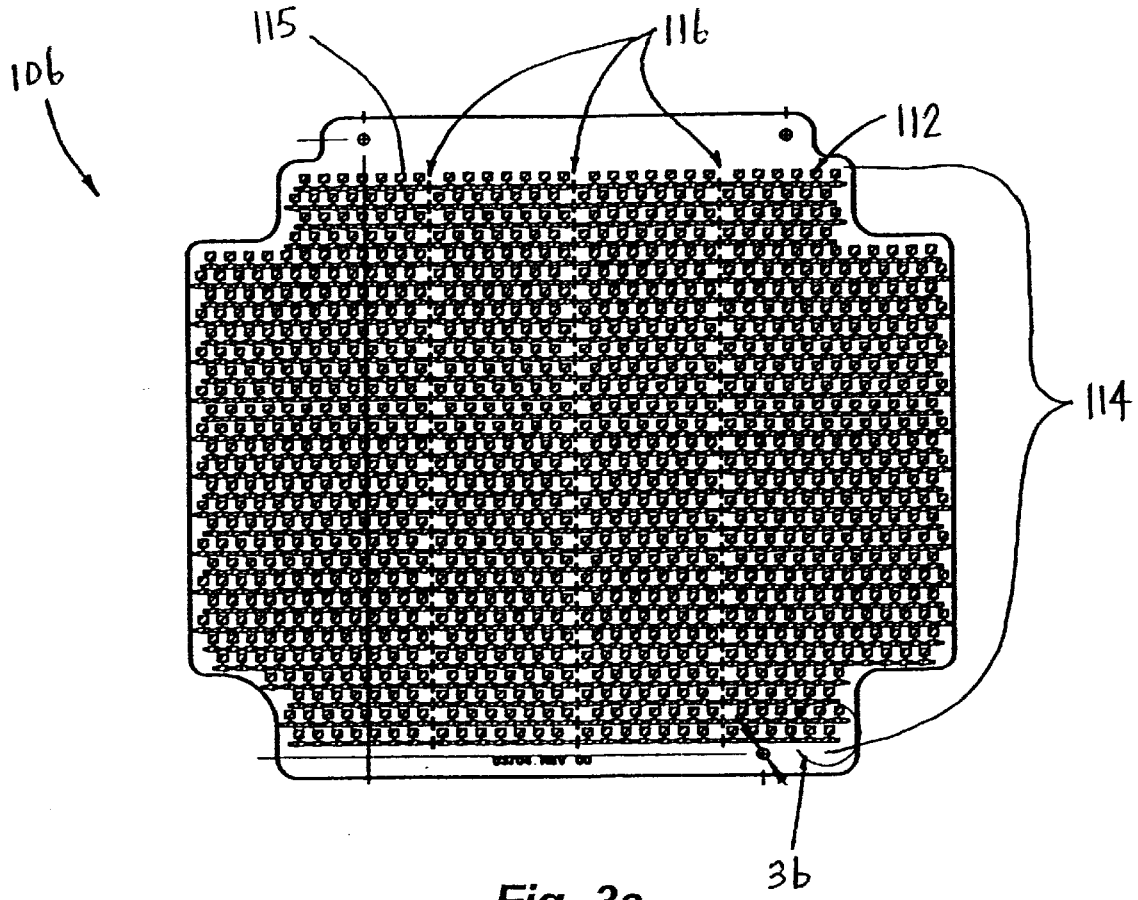
FIG. 3*a* is a top plan view of a microstrip antenna array included in the microstrip antenna array assembly illustrated in FIG. 1.

FIG. 3*a* depicts a top plan view of the circuit board 106 included in the millimeter wave radar system 100 (see FIG. 1), in which a preferred embodiment of the microstrip antenna array 112 is shown. In the illustrated embodiment, the microstrip antenna array 112 includes thirty (30) parallel conductive microstrips 114. Further, each conductive microstrip 114 has three (3) open circuit tuning stubs 116 positioned at regular intervals thereon.

As described above, each rectangular stub 116 is in registration with one of the slots 110 (see FIG. 1), and one (1) slot 110 from each of the three (3) columns of slots 110 feeds an electromagnetic wave from a waveguide to a respective microstrip transmission line of the microstrip antenna array assembly. As a result, phase differences are produced in the waves, which accumulate to cause the antenna elements 115 to transmit three (3) directional beams at predetermined angles.

Figure 3B:
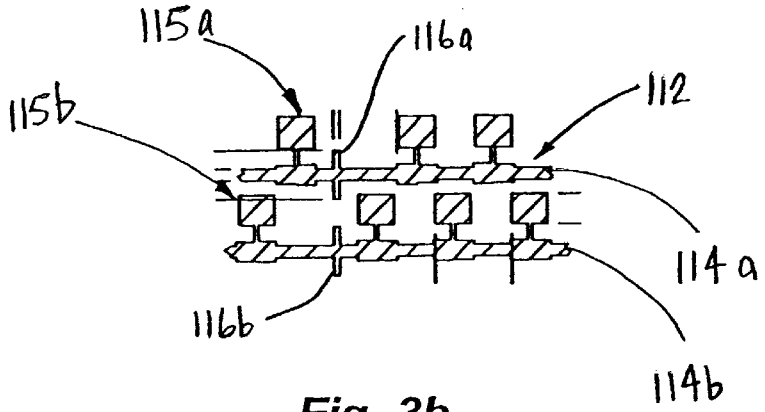
FIG. 3*b* is a detailed view of the microstrip antenna array illustrated in FIG. 3*a*.

FIG. 3*b* depicts a detailed view of the microstrip antenna array 112 including illustrative embodiments of conductive microstrips 114*a* and 114*b*. The conductive microstrip 114*a* has an open circuit rectangular stub 116*a* positioned thereon, and a plurality of antenna elements 115*a* coupled thereto. Similarly, the conductive microstrip 114*b* has an open circuit rectangular stub 116*b* positioned thereon, and a plurality of antenna elements 115*b* coupled thereto. Further, each of the rectangular stubs 116*a* and 116*b* is in registration with a respective slot 110 in the ground plane 104 (see FIG. 1).

Those of ordinary skill in the art will appreciate that waveguide-slot-microstrip transitions can introduce a net inductive reactance at respective microstrip antenna ports of a microstrip antenna array assembly. For this reason, each of the open circuit stubs 116 such as the stubs 116*a* and 116*b* is configured to provide capacitive stub matching to compensate for the net inductance introduced by the waveguide-slot-microstrip transitions. As a result, return loss at the microstrip antenna ports is reduced, thereby allowing full illumination of the microstrip antenna array.

In order to compensate for the net inductive reactance introduced by the waveguide-slot-microstrip transitions, the rectangular stubs 116 (see FIGS. 3*a* and 3*b*) are adjusted to a predetermined length. In a preferred embodiment, the length of the rectangular stubs 116 is equidistant about the respective conductive microstrips 114. Further, the stub length is preferably less than one quarter of a wavelength at the operating frequency of the system, which is preferably about 77 GHz. As described above, the rectangular stubs 116 are positioned on the respective conductive microstrips 114 so that each stub 116 is in registration with a respective slot 110 in the ground plane 104. In a preferred embodiment, the length of the slots 110 is less than one half of a wavelength at the operating frequency of 77 GHz, and the slot width is narrow relative to the wavelength.

Accordingly, when compensating for the net inductive reactance introduced by the waveguide-slot-microstrip transitions, the length of the rectangular stubs 116 is adjusted relative to the length of the slots 110. In a preferred embodiment, the stub lengths are adjusted to provide an impedance of about 50Ω at the waveguide-slot-microstrip transitions.

It is noted that the millimeter wave radar system 100 of FIG. 1 can be used to implement ACC systems in automotive vehicles. For example, the millimeter wave radar system 100 may be mounted on an automotive vehicle (not shown), and the microstrip antenna array 112 may be configured to transmit directional beams to scan a field of view in a roadway ahead of the vehicle and collect information about objects within the field of view. The collected information may include data on the speed, direction, and/or distance of the objects in the roadway relative to the vehicle. The ACC system may subsequently use that information to decide, e.g., whether to alert a driver of the vehicle to a particular obstacle in the roadway and/or automatically change the speed of the vehicle to prevent a collision with the obstacle.

By adjusting the length of the rectangular stubs 116 relative to the length of the respective slots 110 to match the waveguide-slot-microstrip transitions at the microstrip antenna ports, the illumination of a vertical plane of the microstrip antenna array 112 in an ACC application can be improved. This makes it easier to implement a multi-beam automotive antenna using the single microstrip antenna array 112. For example, the microstrip antenna array assembly including the single microstrip antenna array 112 comprising the impedance matching stubs 116, and the ground plane 104 comprising the three (3) columns of collinear slots 110 (see FIG. 1), may be used to implement a three-beam automotive antenna.

It should be noted that although the illustrated embodiment of the millimeter wave radar system 100 includes the rectangular open circuit stubs 116 (see FIGS. 3*a* and 3*b*), the system 100 may alternatively include tuning stubs shaped as squares, fans, arcs, or any other geometrical shape suitable for providing capacitive stub matching. Similarly, the geometrical shape of the radiating antenna elements 115 may take different forms. Further, the electrical parameters of the dielectric substrate, the dimensions of the conductive microstrips 114, the dimensions of the microstrip feed lines, the dimensions of the radiating antenna elements 115, and the size and position of the slots 110 may be modified for further enhancing the performance of the system.

It will be appreciated by those of ordinary skill in the art that modifications to and variations of the above-described system may be made without departing from the inventive concepts disclosed herein. Accordingly, the invention should not be viewed as limited except as by the scope and spirit of the appended claims.

What is claimed is:

1. A millimeter wave radar system, comprising:

a microstrip antenna array assembly comprising a plurality of conductive microstrips, a ground plane, and a dielectric substrate disposed between the plurality of conductive microstrips and the ground plane to form a corresponding plurality of microstrip transmission lines; and a metal plate having at least one channel formed in a surface thereof, the metal plate surface being coupled to the ground plane to form at least one waveguide, wherein the ground plane includes a plurality of apertures disposed relative to the waveguide and the respective microstrip transmission lines to form a corresponding plurality of waveguide-to-microstrip transmission line transitions, and wherein the microstrip antenna array assembly further includes a plurality of tuning stubs coupled to the respective conductive microstrips, the plurality of tuning stubs being in registration with the respective apertures and configured to provide reactive matching for the respective waveguide-to-microstrip transmission line transitions.

2. The system of claim 1 wherein the microstrip antenna array assembly further includes a plurality of radiating elements coupled to each conductive microstrip.

3. The system of claim 1 wherein the apertures are longitudinally located relative to the waveguide and transversely located relative to the respective microstrip transmission lines.

4. The system of claim 1 wherein the plurality of tuning stubs is configured to provide capacitive stub matching to cancel out a net inductive reactance at the respective waveguide-to-microstrip transmission line transitions.

5. The system of claim 1 wherein the plurality of tuning stubs comprises respective open circuit tuning stubs.

6. The system of claim 1 wherein the plurality of tuning stubs comprises respective rectangular tuning stubs disposed equidistant about the respective conductive microstrips.

7. The system of claim 1 wherein the plurality of apertures comprises a plurality of collinear slots.

8. The system of claim 7 wherein the plurality of collinear slots is arranged in a plurality of columns.

9. A millimeter wave radar system, comprising:

a microstrip antenna array assembly configured to transmit and receive a plurality of directional beams, the assembly including a single microstrip antenna array, a ground plane, and a dielectric substrate disposed between the single microstrip antenna array and the ground plane;

a metal plate having a plurality of channels formed in a surface thereof, the metal plate surface being coupled to the ground plane to form a plurality of waveguides; and a plurality of transitions disposed between the single microstrip antenna array and the plurality of waveguides, the plurality of transitions being configured to transfer electromagnetic wave energy between the microstrip antenna array and the plurality of waveguides, wherein the single microstrip antenna array includes a plurality of tuning stubs configured to provide reactive matching for the plurality of transitions.

10. The system of claim 9 wherein the plurality of transitions comprises a plurality of slots formed through the ground plane.

11. The system of claim 10 wherein the plurality of slots comprises a plurality of collinear slots arranged in a plurality of columns.

12. The system of claim 11 wherein the microstrip antenna array assembly is configured to transmit a number of directional beams equal to the number of columns of slots.

13. The system of claim 10 wherein the plurality of tuning stubs is in registration with the respective slots.

14. The system of claim 13 wherein the plurality of tuning stubs comprises a plurality of open circuit tuning stubs.

15. A method of operating a millimeter wave radar system, comprising the steps of:

providing a plurality of first electromagnetic waves to a corresponding plurality of waveguides;

transferring the plurality of first electromagnetic waves from the corresponding plurality of waveguides to a single microstrip antenna array by a plurality of reactive matched waveguide-to-microstrip transmission line transitions, the reactive matching for the plurality of transitions being provided by a plurality of tuning stubs included in the microstrip antenna array; and transmitting a plurality of directional beams corresponding to the plurality of electromagnetic waves by the single microstrip antenna array.

16. The method of claim 15 further including the steps of receiving at least one second electromagnetic wave by the single microstrip antenna array, and transferring the at least one second electromagnetic wave from the single microstrip antenna array to the plurality of waveguides by the plurality of reactive matched waveguide-to-microstrip transmission line transitions.

* * * * *